US006398898B1

(12) United States Patent
Fukui et al.

(10) Patent No.: US 6,398,898 B1
(45) Date of Patent: Jun. 4, 2002

(54) INK IMAGE-RECEIVING SHEET AND METHOD OF FORMING IMAGE USING THE SAME

(75) Inventors: Takuto Fukui; Toshiyuki Yamane; Hideki Suematsu; Kyoichi Suzuki, all of Osaka (JP)

(73) Assignee: Fujicopian Co., Ltd., Osaka-fu (JP)

( * ) Notice: Subject to any disclaimer, the term of this patent is extended or adjusted under 35 U.S.C. 154(b) by 76 days.

(21) Appl. No.: 09/670,899

(22) Filed: Sep. 28, 2000

(30) Foreign Application Priority Data

Sep. 28, 1999 (JP) ..... 11-275114

(51) Int. Cl.[7] ..... B41M 5/00

(52) U.S. Cl. ..... 156/235; 428/195; 428/208; 428/913; 428/914

(58) Field of Search ..... 156/235; 428/195, 428/208, 913, 914

(56) References Cited

U.S. PATENT DOCUMENTS

| | | | | |
|---|---|---|---|---|
| 5,521,626 | A | 5/1996 | Tanaka et al. | 347/183 |
| 5,538,577 | A | 7/1996 | Negoro | 156/235 |
| 5,569,347 | A | 10/1996 | Obata et al. | 156/235 |
| 5,597,641 | A | 1/1997 | Suematsu et al. | 428/195 |
| 6,133,929 | A | 10/2000 | Negoro | 347/171 |

FOREIGN PATENT DOCUMENTS

| | | |
|---|---|---|
| JP | 8090928 | 4/1996 |

*Primary Examiner*—Bruce H. Hess
(74) *Attorney, Agent, or Firm*—Fish & Neave

(57) ABSTRACT

An ink image-receiving sheet for use in a method of forming an image, comprising an ink-receiving layer having a porous structure formed according to a wet-solidification method, the ink-receiving layer comprising a binder resin and aragonite-type calcium carbonate as main components, and a method of forming an image using the ink image-receiving sheet.

6 Claims, No Drawings

INK IMAGE-RECEIVING SHEET AND METHOD OF FORMING IMAGE USING THE SAME

BACKGROUND OF THE INVENTION

The present invention relates to an ink image-receiving sheet which is excellent in writing property, and on which an image that is excellent in gradation reproducibility and dot reproducibility including variable performance and color clearness can be formed by using a thermal transfer printer, and a method of forming an image wherein the ink image-receiving sheet is used.

With respect to a method of forming a high-definition image through a thermal transfer printer, a method of forming an image comprising: using an image-receiving body having a porous layer, and melt-transferring ink from thermal transfer sheets of yellow, magenta, and cyan, (if necessary, black or the like) thereupon, wherein a heat-meltable ink in a molten state is infiltrated into pores in the porous layer was previously reported in Institute of Television Technical Report, ITE Technical Report, Vol.17, No.27 (May, 1993), p.19-24. Furthermore, as a method of forming a porous layer, the following are known: Wet-solidification method or wet-coagulation method (hereinafter referred to as "wet-solidification method"), which is a method of forming a porous layer wherein a sheet on which a solution of a binder resin in dimethylformamide is applied is dipped into water, thereby replacing the dimethylformamide with water, see JP, B, 49-25430, and JP, A, 5-155163; Mechanically agitating foaming method, which is a method of forming a porous layer wherein a binder resin is mechanically agitated and foamed, and thereafter, the resultant is applied on a sheet, see JP, A, 7-32753, and JP, A, 7-309074; Pigment addition method, which is a method of forming a porous layer wherein a porous pigment is added into a binder resin so as to utilize the oil-absorbing property of the pigment, see JP, A, 3-98333, and JP, B2, 2535371; Solvent-dissolving method or dry method, which is a method of forming a porous layer wherein a binder resin is dissolved into a mixture of a good solvent having a low boiling point and a poor solvent having a high boiling point, and the resultant is dried so that the voids which remain after the poor solvent which is slow in drying is removed by drying form pores, see JP, A, 4-82790, and JP, A, 6-166283; Foaming agent method, which is a method of forming a porous layer wherein a foaming agent which generates a gas upon heating is added into a binder resin, see JP, A, 2-3396; Method of dissolving and removing soluble particles, which is a method of forming a porous layer wherein soluble particles are added into a binder resin and the resultant is formed into a film, and the film is then washed to remove the soluble particles, JP, A, 6-171250; and the like. However, even according to any of those methods, it is difficult to control the state of pores formed in an ink-receiving layer, which is considered to be most important in a thermal transfer of infiltration type, and as a result, there is a problem that the number of pores in the ink-receiving layer is decreased so that an infiltration of ink cannot be sufficiently attained, or a problem that the pore size becomes too large, which exerts a bad influence upon a transfer of fine dots.

Among the above-mentioned methods of forming a porous layer, the wet-solidification method is a method by which a large number of pores can be relatively easily formed in an ink-receiving layer, and thus various technologies have been investigated. Among them, technologies of adding a filler component to a binder component in order to improve the strength of the ink-receiving layer was reported in JP, B, 49-25430 (which discloses wet-solidification using a styrene resin, a plasticizer and a filler), and JP, B, 5-18332 (which discloses wet-solidification using a polyester resin, a plasticizer and a filler). However, even in ink-receiving porous layers formed according to these technologies, pores therein have a too large pore size, and the pores are coarse. Therefore, on thermal transfer printing, an infiltration of ink cannot be sufficiently attained, and thus, it is difficult to form dots in a uniform shape. In particular, when a full-color printing is carried out, a second color ink or subsequent color ink(s) which are to be overlapped with a first color ink or with each other cause an inferior transfer, and thus, it has been difficult to form a high-definition image.

The present inventors have evaluated various types of image-receiving sheets based on the prior art mentioned above. With respect to the mechanically agitating foaming method and wet-solidification method, each of which is considered to largely leave room for improvement from the view point of forming a high-quality image as compared with conventional image-receiving sheets, the characteristics of each of these methods are put in order as follows: Namely, in the case of an image-receiving sheet having an ink-receiving layer comprising a micro-porous layer formed according to the mechanically agitating foaming method, an aqueous coating liquid can be used, and the image-receiving sheet can be formed by merely drying after application of the aqueous coating liquid, and thus this type of image-receiving sheet has the advantage that a paper support can be used, and a support for the image-receiving sheet has a wide range of choice, while communicating pores have a large variation in pore size and a lot of the pores have a large pore size, and thus this type of image-receiving sheet has, for example, the disadvantage that it is difficult to form a sharp dot, small dots in a highlight region cause an outstanding rough appearance, it is difficult to provide a high maximum density, and the gloss of the obtained image is inferior. On the other hand, in the case of an image-receiving sheet having an ink-receiving layer comprising a micro-porous layer formed according to the wet-solidification method, a support of pure paper cannot be used due to the process, and manufacturing costs are high, but from the view point of forming a high-quality image, communicating pores have a small variation in pore size and a little of the pores have a large pore size as compared with the mechanically agitating foaming method, and thus the performance is largely improved. However, in order to stand comparison with a sublimation transfer method or to be superior thereto, a lot of improvement is necessary.

Furthermore, using an image-receiving sheet having an ink-receiving layer comprising a micro-porous layer, which was formed according to the wet-solidification method as disclosed in JP, A, 62-197183, which is one of methods as disclosed in JP, A, 6-286181, the present inventors evaluated the overlapping properties of a second color, a third color and a fourth color. As a result, this type of image-receiving sheet had the disadvantage that a flow of ink and a deficiency of dot were found in a large amount of dots from an intermediate density region to a shadow region. In order to provide a color image having a high-quality, it is very important to evaluate not only the quality of a first color but also overlapping properties of a second color and subsequent color(s). However, as far as the present inventors know, none of conventional technologies as publicly known refer thereto.

It is an object of the present invention to provide an ink image-receiving sheet used in a melting type of thermal transfer recording system, which is excellent in receiving property of transferred ink, and capable of forming thereon an image of a high quality and a high-definition which is excellent in dot reproducibility and gradation property, in particular when a full-color printing is carried out.

Another object of the present invention is to provide an ink image-receiving sheet having a surface layer wherein a lot of pores having an average pore size of preferably 1 to 5 $\mu$m and a small variation in size and shape are formed.

A still another object of the present invention is to provide an ink image-receiving sheet which is excellent in writing property.

A further object of the present invention is to provide a method of forming an image by using the above-mentioned ink image-receiving sheet having an excellent receiving property to transferred ink, which is capable of forming thereon an image which is excellent in dot reproducibility and gradation property, in particular, dot reproducibility of a second color or subsequent color(s) when a color image is formed.

These and other objects of the present invention will become apparent from the description hereinafter.

SUMMARY OF THE INVENTION

The present inventors have eagerly investigated in order to achieve the above objects. Consequently, we have found that according to a method comprising the steps of: providing an ink image-receiving sheet comprising an ink-receiving layer having a porous structure formed according to a wet-solidification method, the ink-receiving layer containing a binder resin and aragonite-type calcium carbonate as main components; and melting a heat-meltable ink or each of a plurality of different color heat-meltable inks by heat provided through a printer head on heat-transferring to infiltrate each ink into the porous structure of the ink-receiving layer, an image which is excellent in gradation reproducibility and dot reproducibility including variable performance, in particular, dot reproducibility of a second color and subsequent color(s) when a color picture image is formed, and color clearness can be realized; and that the ink image-receiving sheet is excellent in writing property.

That is to say, the present invention set forth in claim 1 provides an ink image-receiving sheet for use in a method of forming an image, comprising an ink-receiving layer having a porous structure formed according to a wet-solidification method, the ink-receiving layer comprising a binder resin and aragonite-type calcium carbonate as main components.

The present invention set forth in claim 2 provides the ink image-receiving sheet of claim 1, wherein a weight ratio of the binder resin to the aragonite-type calcium carbonate is in the range of 70:30 to 35:65, and a rate of porosity of the ink-receiving layer is in the range of 30 to 70%.

The present invention set forth in claim 3 provides the ink image-receiving sheet of any one of claims 1 or 2, wherein the binder resin comprises at least one member selected from the group consisting of a polyester resin, a poly (vinyl butyral) resin, a poly (vinyl acetal) resin, a polyurethane resin, a styrene resin, an acrylonitrile copolymer, a vinyl chloride resin, a vinyl acetate resin and a styrene-butadiene copolymer.

The present invention set forth in claim 4 provides the ink image-receiving sheet of any one of claims 1 to 3, wherein the binder resin contains at least a polyurethane resin.

The present invention set forth in claim 5 provides a method of forming an image, comprising the steps of: superimposing an ink image-receiving sheet having a porous ink-receiving layer and a heat-meltable ink on a thermal transfer sheet; and melting the ink by heat provided through a thermal transfer printer head from the back side of the thermal transfer sheet, thereby infiltrating the ink into the porous ink-receiving layer of the ink image-receiving sheet to form an image, wherein the ink image-receiving sheet comprises an ink-receiving layer having a porous structure formed according to a wet-solidification method, the ink-receiving layer comprising a binder resin and aragonite-type calcium carbonate as main components.

The present invention set forth in claim 6 provides a method of forming an image, comprising the steps of: superimposing an ink image-receiving sheet having a porous ink-receiving layer and each of a plurality of different color heat-meltable inks on a thermal transfer sheet or on a plurality of thermal transfer sheets; and melting each ink by heat provided through a thermal transfer printer head from the back side of the thermal transfer sheet, thereby successively infiltrating the plurality of different color inks into the porous ink-receiving layer of the ink image-receiving sheet to form a color image, wherein the ink image-receiving sheet comprises an ink-receiving layer having a porous structure formed according to a wet-solidification method, the ink-receiving layer comprising a binder resin and aragonite-type calcium carbonate as main components.

According to the present invention, it has been found that a coating liquid comprising a binder resin and an aragonite-type calcium carbonate is applied onto one side of a substrate, wherein the aragonite-type calcium carbonate is dispersed in the binder resin, the binder resin is preferably one or more selected from the group consisting of a poly (vinyl acetal) resin, a poly (vinyl butyral) resin, a polyurethane resin, a polyester resin, and the like, which resins are commonly used in the wet-solidification method, and the aragonite-type calcium carbonate is pulverized and dispersed in an average particle size of preferably 2.5 $\mu$m or less, more preferably 1.5 $\mu$m or less; and the applied coating is made into a porous structure by the wet-solidification method, whereby pores uniform in shape and dense can be formed in an ink-receiving layer. Furthermore, it has been found that when a full-color printing is carried out by using different color heat-meltable inks (e.g. yellow ink, magenta ink, cyan ink, and the like) each containing a wax as a main component on an image-receiving sheet as produced according to this method, even a second color ink and subsequent color ink(s) can be sufficiently infiltrated into the porous ink-receiving layer; a color image having a rich gradation representation and a high definition which could not be represented by the conventional area gradation method can be formed, wherein a jumping-up of a density near a saturated density in a high density region is not caused; fine dots having a uniform shape in a low density region can be reproduced. Besides, it has been found that by using an aragonite-type calcium carbonate, the hardness of the surface of the ink-receiving layer is increased, and writing properties, in particular writing properties in pencil are improved.

DETAILED DESCRIPTION

Hereinafter, the present invention will be described in detail.

In the present invention, as a substrate for an ink image-receiving sheet, a common plastic film or sheet, a white plastic film or sheet prepared by addition of a white pigment or the like to a plastic, a foamed plastic film or sheet, a synthetic paper sheet, a paper sheet such as laminated paper sheet which is provided with water resisting property, and the like can be used. Furthermore, a primer layer may be provided to these materials in order to improve adhesive property between an ink-receiving layer and the substrate, or an electrostatic protection treatment or a corona treatment may be applied thereto. Besides, if necessary, a layer for providing sliding property or an antistatic layer may be provided on the rear side.

A coating liquid for an ink-receiving layer is applied onto the surface of the substrate for an image-receiving sheet and the resultant coating layer is made into an ink-receiving layer having a porous structure according to a wet-solidification method.

First, the wet-solidification method will be explained. In the wet-solidification method, a coating liquid for an ink-receiving layer in which a binder resin is dissolved in an organic solvent is applied onto a substrate, and thereafter the substrate with a coating layer of the coating liquid is immersed into a bath containing a treating liquid which is compatible with the organic solvent above, and in which the binder resin above is not dissolved. The organic solvent in the coating layer and the treating liquid in the bath are highly compatible with each other, and therefore, a substitution between both is caused, the organic solvent in the coating layer is outflowed into the bath, while the treating liquid in the bath is infiltrated into the coating layer, wherein the binder resin in the coating layer is not dissolved in the treating liquid infiltrated from the bath, and thus solidified. Thereby, sites from which the solvent in the coating layer has been removed form voids, and thus a porous layer is produced. In this respect, JP, B, 49-25430 and JP, B, 5-18332 discloses a method wherein fine particles as a third composition are added to a coating liquid for an ink-receiving layer; and JP, B, 5-87311 discloses a method wherein two or more resins which are low in miscibility with each other can be used as a binder resin.

A coating liquid for an ink-receiving layer as used in the present invention comprises one or more binder resins as a main component, an organic solvent, and an aragonite-type calcium carbonate, wherein the binder resin(s) is dissolved in the organic solvent, and the aragonite-type calcium carbonate is dispersed therein. Hereinafter, each of the components will be explained.

In the present invention, as a binder resin used in a coating liquid for an ink-receiving layer, the following are used: polyester resins, poly(vinyl butyral) resin, poly(vinyl acetal) resin, polyurethane resins, styrene resins, acrylonitrile copolymers, vinyl chloride resins, vinyl acetate resins and styrene-butadiene copolymers, and the like. These binder resins may be used alone, or may be used in combination of two or more species thereof. In particular, from the view point of easy formation of pores, the binder resin preferably contains at least a polyurethane resin. Examples of the polyurethane resins usable in the present invention include polyester type polyurethane resins, polyether type polyurethane resins, polyamide type polyurethane resins, polycarbonate type polyurethane resins, and the like. However, from the view point of carrying out the wet-solidification method, polyester type polyurethane resins are most desirable.

Then, an aragonite-type calcium carbonate used in a coating liquid for an ink-receiving layer in the present invention will be explained. In the case of light calcium carbonate (precipitated calcium carbonate) such as an aragonite-type calcium carbonate, which is chemically synthesized, a lot of primary particles are usually bonded with each other to form a secondary agglomerate. However, in the present invention, an aragonite-type calcium carbonate may be dispersed in a binder in such a state that an agglomerate structure remains, or may be dispersed in the binder in such a state that an agglomerate structure is broken into an optional size. However, it is preferable to use an aragonite-type calcium carbonate in such a state that it is pulverized and homogeneously dispersed in the binder by a dispersing machine using media till the agglomerate structure is broken (till the aragonite-type calcium carbonate has an average particle size of 2.5 $\mu$m or less, preferably 1.5 $\mu$m or less). In the case that the agglomerate structure is not sufficiently broken, a secondary agglomerate tends to emerge on the surface of an ink-receiving layer which is formed according to the wet-solidification method, and thus smoothness of the surface cannot be sufficiently provided. Consequently, it becomes difficult to form dots having a uniform shape, and a rough appearance is caused in a highlight region due to a deficiency or a loss of fine dots. Therefore, it becomes difficult to form a high-definition image.

As a dispersing machine using media, vessel type mills such as attritor and centri mill; flow cylinder type mills as sand grinder, dyno mill, grain mill, pearl mill or matter mill; annular type mills such as conical ball mill; and the like can be preferably used. Examples of media used on dispersing include natural or synthetic fine particles such as flint stones, Ottawa sands, steel balls, alumina balls, zirconia beads or glass beads can be enumerated. A vessel is filled with these media, the media are mechanically agitated through agitating blades having a predetermined shape, while a liquid to be dispersed is passed one or more times, thereby pulverizing an aragonite calcium carbonate and dispersing the resultant into the binder.

The weight ratio of a binder resin to an aragonite calcium carbonate is preferably in the range of 70:30 to 35:65. When the ratio of the binder resin is larger than this range, the effect of the aragonite calcium carbonate on forming pores, in particular the effect thereof on forming pores in the surface of an ink-receiving layer is decreased. Thus, when a printing using a heat-meltable ink is carried out, an infiltration of ink into the ink-receiving layer is decreased, and the shape of dots is deteriorated. When the ratio of the aragonite calcium carbonate is larger than this range, the strength of the surface of the ink-receiving layer is decreased, and particles fall out even due to a weak frictional force. Consequently, writing properties are decreased.

Furthermore, in order to control the shape of pores, various surface active agents or other additive agents may be added to a coating liquid for an ink-receiving layer.

Then, the organic solvent which is used in a coating liquid for an ink-receiving layer and the treating liquid in the present invention will be explained. With respect to the solvent, various organic solvents which have a high power for dissolving a resin used as a binder in the present invention and are highly compatible with a treating liquid used in a bath in the present invention can be used. Examples of solvents used in the present invention include N, N-dimethylformamide, N, N-dimethylacetamide, dimethyl sulfoxide, tetrahydrofuran, tetramethylurea, N-methyl-2-pyrrolidone, ethyl acetate, dioxane, butylcarbinol, toluene, phenol, chloroform, γ-butyrolactone, and ketones and alcohols. Among them, N, N-dimethylformamide is commonly highly compatible with a suitable treating liquid such as water, and at the same time has a high power for dissolving a lot of resins, and thus is a suitable organic solvent in the wet-solidification method. As the treating liquid used in the bath, taking into consideration compatibility with these solvents and incompatibility with the binder resins, the following are suitably selected for use: water, acetone, ethanol, toluene, tetrachloroethylene, methyl isobutyl ketone, chloroform, hexane, and the like.

A coating liquid for an ink-receiving layer is applied onto a substrate. As a method of applying the coating liquid, the following various conventional methods can be used: reverse roll coating, air knife coating, gravure coating, blade coating, comma coating, rod coating, and the like. A substrate with a coating layer of the coating liquid for the ink-receiving layer is immersed into a bath so as to make the coating layer into a porous layer, giving an ink-receiving layer.

Thus, an ink image-receiving sheet in which an ink-receiving layer includes a lot of pores having an average pore size of preferably 1 to 5 $\mu$m and a small variation in size and shape can be provided. Regarding the ink-receiving layer, a ratio occupied by pores in the layer, namely a rate of porosity is preferably in the range of 30 to 70%. The rate of porosity can be determined by the following formula:

$$\text{Rate of porosity } (\%)=(1-w/dh)\times 100$$

wherein w: Dry weight of ink-receiving layer (g/m$^2$), d: True specific gravity of ink-receiving layer (g/cm$^3$), and h: Thickness of ink-receiving layer ($\mu$m).

When the rate of porosity is larger than this range, the strength of the ink-receiving layer itself is decreased, and thus when a printing is carried out, the layer cannot be restored into original shape by itself due to pressure pushed by a thermal printer head, and thus when in particular a second color and subsequent color(s) are printed, the thermal printer head cannot come into close contact with the ink-receiving layer, and thereby a heat-meltable ink is not sufficiently melted, and it becomes difficult to form uniform dots, in particular in a low density region. Furthermore, when the rate of porosity is smaller than this range, the flexibility of the layer is decreased, namely, the cushion property is decreased, and thereby as shown when the rate of porosity is larger, the thermal printer head cannot come into close contact with the ink-receiving layer, resulting in a decreased dot reproducibility. Furthermore, since the volume of pores in the layer is decreased, a sufficient amount of heat-meltable ink cannot be infiltrated, and thus the shape of dots of a second color and subsequent color(s) is deteriorated. A thickness of about 5 $\mu$m to about 50 $\mu$m is suitable for the ink-receiving layer. If necessary, a layer for providing sliding property or an antistatic layer may be provided on the ink-receiving layer.

As the thermal transfer sheet which is used in combination with the ink image-receiving sheet, a thermal transfer sheet having a heat-meltable ink containing a wax as a main component is most suitable, wherein the ink is melted with heat provided from a printer head on heat-transferring, and infiltrated into a porous structure of the ink-receiving layer. Besides, a bridge type of heat-transfer sheet having a semi-resin type of ink which contains a resin and a wax as main components can also be used. The thermal transfer sheet may be one in which colored ink layers of a plurality of colors are repeatedly arranged on the same substrate in a side-by-side relationship, and may be one in which each of colored ink layers is arranged on a discrete substrate. Usually, the plural colors include yellow, magenta and cyan, and if necessary, black.

The present invention will be described in detail by way of Examples and Comparative Examples. It is to be understood that the present invention will not be limited to these Examples, and various changes and modifications may be made in the invention without departing from the spirit and scope thereof. The unit "part(s)" in the Examples and Comparative Examples represents "part(s) by weight".

Preparation of Ink Image-receiving Sheets

EXAMPLE 1

A mixture of the following Composition-1 underwent to a pulverizing/dispersing treatment so that aragonite-type calcium carbonate was pulverized into an average particle size of 1.0 $\mu$m, yielding a coating liquid for an ink-receiving layer. The coating liquid was applied onto one side of a poly (ethylene terephthalate) film having a thickness of 100 $\mu$m. Then, the resultant coated film was immersed in water at a temperature of 20° C. for a period of 60 seconds, and further immersed in hot water at a temperature of 80° C. for a period of 10 seconds, and taken out therefrom, followed by drying. Thus, an ink image-receiving sheet having an ink-receiving layer with a thickness of 15.0 $\mu$m was obtained. The ink-receiving layer had a porosity of 41%.

Composition-1

| Ingredients | Parts |
|---|---|
| Polyester resin (Vylon 200, made by TOYOBO CO., LTD.) | 100 |
| Aragonite-type calcium carbonate (Tama Pearl TP123, made by Okutama Kogyo Co., Ltd.) | 100 |
| N,N-dimethylformamide | 800 |

COMPARATIVE EXAMPLE 1

Regarding the formation of an ink-receiving layer, an ink-receiving layer having a thickness of 15.0 $\mu$m was formed in the same manner as in Example 1 except that a mixture of the following Composition-2 was used. The ink-receiving layer had a porosity of 38%.

Composition-2

| Ingredients | Parts |
|---|---|
| Polyester resin (Vylon 200, made by TOYOBO CO., LTD.) | 100 |
| Calcite-type calcium carbonate (Tama Pearl TP121, made by Okutama Kogyo Co., Ltd.) | 100 |
| N,N-dimethylformamide | 800 |

EXAMPLE 2

Regarding the formation of an ink-receiving layer, an ink-receiving layer having a thickness of 15.0 $\mu$m was formed in the same manner as in Example 1 except that a mixture of the following Composition-3 was used. The ink-receiving layer had a porosity of 56%.

Composition-3

| Ingredients | Parts |
|---|---|
| Poly(vinyl butyral) resin (Denka Butyral 2000L, made by DENKI KAGAKU KOGYO KABUSHIKI KAISHA) | 100 |
| Aragonite-type calcium carbonate (Tama Pearl TP123, made by Okutama Kogyo Co., Ltd.) | 100 |
| N,N-dimethylformamide | 800 |

EXAMPLE 3

Regarding the formation of an ink-receiving layer, an ink-receiving layer having a thickness of 15.0 μm was formed in the same manner as in Example 1 except that a mixture of the following Composition-4 was used, and the conditions for wet-solidification that a coated film was immersed in hot water at a temperature of 75° C. for a period of 10 seconds, and immersed in water at a temperature of 20° C. for a period of 60 seconds, and thereafter immersed in hot water at a temperature of 80° C. for a period of 10 seconds were employed. The ink-receiving layer had a porosity of 36%.

Composition-4

| Ingredients | Parts |
|---|---|
| Polyurethane resin (Crisvon 8016P, made by DAINIPPON INK & CHEMICALS, INC.) | 100 |
| Aragonite-type calcium carbonate (Tama Pearl TP123, made by Okutama Kogyo Co., Ltd.) | 100 |
| N,N-dimethylformamide | 800 |

EXAMPLE 4

Regarding the formation of an ink-receiving layer, an ink-receiving layer having a thickness of 15.0 μm was formed in the same manner as in Example 1 except that a mixture of the following Composition-5 was used. The ink-receiving layer had a porosity of 43%.

Composition-5

| Ingredients | Parts |
|---|---|
| Polyester resin (Vylon 200, made by TOYOBO CO., LTD.) | 140 |
| Aragonite-type calcium carbonate (Tama Pearl TP123, made by Okutama Kogyo Co., Ltd.) | 60 |
| N,N-dimethylformamide | 800 |

EXAMPLE 5

Regarding the formation of an ink-receiving layer, an ink-receiving layer having a thickness of 15.0 μm was formed in the same manner as in Example 1 except that a mixture of the following Composition-6 was used. The ink-receiving layer had a porosity of 38%.

Composition-6

| Ingredients | Parts |
|---|---|
| Polyester resin (Vylon 200, made by TOYOBO CO., LTD.) | 70 |
| Aragonite-type calcium carbonate (Tama Pearl TP123, made by Okutama Kogyo Co., Ltd.) | 130 |
| N,N-dimethylformamide | 800 |

COMPARATIVE EXAMPLE 2

A mixture of the following Composition-7 was applied onto one side of a poly(ethylene terephthalate) film having a thickness of 100 μm, and the resultant coated film was immersed in water at a temperature of 20° C. for a period of 60 seconds, and immersed in hot water at a temperature of 90° C. for a period of 5 seconds, and water was removed therefrom, followed by drying. Thus, an ink image-receiving sheet having an ink-receiving layer with a thickness of 30.0 μm was obtained. The ink-receiving layer had a porosity of 70%.

Composition-7

| Ingredients | Parts |
|---|---|
| Poly(vinyl chloride) resin | 100 |
| Poly(acrylonitrile) resin | 60 |
| N,N-dimethylformamide | 640 |

COMPARATIVE EXAMPLE 3

A mixture of the following Composition-8 underwent to a dispersing treatment using an impeller type agitator, while maintaining an agglomerate structure of aragonite type calcium carbonate. The resultant dispersion was applied onto one side of a woodfree paper sheet having a basis weight of 53 g/m$^2$, dried and subjected to a super-calender treatment for smoothing to form an ink-receiving layer having a basis weight of 20 g/m$^2$. The porosity of the ink-receiving layer could not be determined, because a part of the ink-receiving layer was infiltrated into the woodfree paper sheet.

Composition-8

| Ingredients | Parts |
|---|---|
| Carboxyl-modified styrene-butadiene latex (T-038, made by Nippon Synthetic Rubber Co., Ltd.) | 30 |
| Poly(vinyl alcohol) (PVA 205, made by KURARAY CO., LTD.) | 2 |
| Aragonite-type calcium carbonate (Cal-light SA, made by Kabushiki Kaisha Shiraishi Chuo Kenkyusho) | 100 |
| Sodium Polyacrylate (Aron T-40, made by Toagosei Co., Ltd.) | 2 |
| Water | 133 |

Preparation of Thermal Transfer Sheets

A stick preventive layer composed of a modified silicone resin having a thickness of 0.1 μm was formed on one side of a poly(ethylene terephthalate) film having a thickness of 4.5 μm. Each of colored inks mentioned below was applied onto the other side of the film according to a hot-melt coating method to form a colored ink layer having a thickness of 2.0 μm. Thus a yellow thermal transfer sheet, a magenta thermal transfer sheet, a cyan thermal transfer sheet and a black thermal transfer sheet were obtained.

Inks for Colored Ink Layers

| Ingredients | Parts |
|---|---|
| Yellow ink | |
| Yellow pigment (C. I. P. Y. 14) | 15.0 |
| Paraffin wax | 60.0 |
| Carnauba wax | 20.0 |
| Ethylene-vinyl acetate copolymer | 5.0 |
| magenta ink | |
| Magenta pigment (C. I. P. R. 57:1) | 15.0 |
| Paraffin wax | 60.0 |
| Carnauba wax | 20.0 |
| Ethylene-vinyl acetate copolymer | 5.0 |
| Cyan ink | |
| Cyan pigment (C. I. P. B. 15:3) | 15.0 |
| Paraffin wax | 60.0 |
| Carnauba wax | 20.0 |
| Ethylene-vinyl acetate copolymer | 5.0 |
| Black ink | |
| Carbon black | 15.0 |
| Paraffin wax | 60.0 |
| Carnauba wax | 20.0 |
| Ethylene-vinyl acetate copolymer | 5.0 |

The above-mentioned ink image-receiving sheets and thermal transfer sheets were used to carry out printing by using a variable dot type thermal transfer color printer (Dot density: 300 dots/inch; Printing energy: variable in the range of 0 to 0.12 mJ/dot, and Printing speed: 10 msec/line), and then the minimum dot diameter, minimum dot shape and number of density gradations mentioned below were determined, and further ink-infiltrating properties and writing properties were evaluated. The results are shown in Table 1.

Evaluation Method (1) Minimum Dot Diameter

A thermal transfer sheet of black was used to carry out printing by using the aforesaid printer, wherein printing energy was modulated into 256 steps; and then, a diameter of dot (a length of long side) of the black ink which was transferred with minimum energy in the obtained print image was determined through an electron microscope.

(2) Minimum Dot Shape

Printing was carried out in the same manner as in the above-mentioned (1), and then, the shape of a dot of the black ink which was transferred with minimum energy in the obtained print image was observed through an electron microscope, and evaluated on the basis of the following criteria, wherein a score of 4 or more is of a commercial level.

5: There are no deficiency and no void in each dot in the same density region, and a uniform dot is reproduced.

4: There are a deficiency and a void in a part of each dot in the same density region, but a substantially uniform dot is reproduced.

3: There are a deficiency and a void in a part of each dot and a deficiency of dots in the same density region.

2: There are a lot of deficiency and a lot of void in each dot and a lot of deficiency of dots in the same density region.

1: There are a lot of deficiency and a lot of void in each dot and a lot of deficiency of dots in the same density region, resulting in a remarkably rough appearance as an image.

(3) Number of Density Gradations

Printing was carried out in the same manner as in the above-mentioned (1), wherein printing energy was modulated into 256 steps with a constant gradual change. Then, the number of the steps in which a significant difference between reflecting optical densities (OD values) of the obtained images is observed was determined, wherein a score of 4 or more is of a commercial level.

5: Number of gradations: 96 or more

4: Number of gradations: 64 to 95

3: Number of gradations: 32 to 63

2: Number of gradations: 16 to 31

1: Number of gradations: 15 or less (4) Ink Infiltrating Properties

On each of the ink image-receiving sheets, a non-printed area; an area on which yellow ink was solid-transferred, an area on which yellow ink was solid-transferred and then magenta ink was solid-transferred thereon; and an area on which yellow ink was solid-transferred, magenta ink was solid-transferred thereon, and further cyan ink was solid-transferred thereon; were formed, and 256 gradation patterns were printed in black ink on each of the aforesaid areas. Then, a degree of deformation in the shape of dots in black ink on each of the printed matters was observed through a microscope, and evaluated on the basis of the following criteria. Herein, the term "a first color ink" means black ink transferred onto the non-printed area; the term "a second color ink" means black ink transferred onto the area where yellow ink was solid-transferred; the term "a third color ink" means black ink transferred onto the area where yellow ink was solid-transferred, and thereafter magenta ink was solid-transferred thereonto; and the term "a fourth color ink" means black ink transferred onto the area where yellow ink was solid-transferred, magenta ink was solid-transferred thereonto, and thereafter cyan ink was solid-transferred thereonto. According to the present evaluation method, degrees of deformation in the shape of dots in black ink as the top layer are observed so that not only infiltrating properties of black ink but also infiltrating properties of ink on a lower layer can be evaluated, wherein a score of 4 or more is of a commercial level.

5: The shape of dots from a first color ink to a fourth color ink is uniform.

4: The shape of dots from a first color ink to a third color ink is uniform, but a part of a fourth color ink only is not infiltrated, and is overflowed from pores.

3: The shape of dots from a first color ink to a third color ink is uniform, but a fourth color ink only is not infiltrated, and is overflowed from pores.

2: The shape of dots from a first color ink to a second color ink is uniform, but a part of a third color ink and a fourth color ink are not infiltrated, and are overflowed from pores.

1: The shape of dots from a first color ink to a second color ink is uniform, but a third color ink and a fourth color ink are not infiltrated, and are overflowed from pores.

(5) Writing Properties

Characters are written on the surface of each of ink image-receiving sheets with a pencil, a ball pen and an oil-based ink pen, and writing properties were evaluated, wherein a score of 4 or more is of a commercial level.

5: It is possible to write with pencil, ball pen or oil-based ink pen without scratching.

4: It is possible to write with ball pen or oil-based ink pen without scratching, but writing with pencil causes somewhat scratching.

3: It is possible to write with ball pen or oil-based ink pen without scratching, but it is impossible to write with pencil.

2: Writing with ball pen or oil-based ink pen causes somewhat scratching.

1: It is impossible to write with pencil, ball pen or oil-based ink pen.

TABLE 1

| | Minimum dot | | | | |
|---|---|---|---|---|---|
| | Diameter (μm) | Shape | Number of gradations | Ink infiltrating property | Writing property |
| Ex.1 | 15 | 5 | 4 | 4 | 5 |
| Ex.2 | 20 | 5 | 4 | 4 | 5 |
| Ex.3 | 15 | 5 | 5 | 4 | 5 |
| Ex.4 | 15 | 5 | 4 | 4 | 4 |
| Ex.5 | 15 | 4 | 4 | 5 | 4 |
| Com.Ex.1 | 15 | 3 | 4 | 3 | 5 |
| Com.Ex.2 | 20 | 2 | 2 | 2 | 3 |
| Com.Ex.3 | 50 | 2 | 1 | 1 | 4 |

The ink image-receiving sheet can provide thereon an image which is excellent in gradation reproducibility and dot reproducibility including variable performance, in particular, dot reproducibility of a second color and subsequent color(s) when a color picture image is formed, and the ink image-receiving sheet is also excellent in writing property.

What is claimed is:

1. An ink image-receiving sheet for use in a method of forming an image, comprising an ink-receiving layer having a porous structure formed according to a wet-solidification method, the ink-receiving layer comprising a binder resin and aragonite-type calcium carbonate as main components.

2. The ink image-receiving sheet of claim 1, wherein a weight ratio of the binder resin to the aragonite-type calcium carbonate is in the range of 70:30 to 35:65, and a rate of porosity of the ink-receiving layer is in the range of 30 to 70%.

3. The ink image-receiving sheet of claim 1, wherein the binder resin comprises at least one member selected from the group consisting of a polyester resin, a poly (vinyl butyral) resin, a poly (vinyl acetal) resin, a polyurethane resin, a styrene resin, an acrylonitrile copolymer, a vinyl chloride resin, a vinyl acetate resin and a styrene-butadiene copolymer.

4. The ink image-receiving sheet of claim 1, wherein the binder resin contains at least a polyurethane resin.

5. A method of forming an image, comprising the steps of:

superimposing an ink image-receiving sheet having a porous ink-receiving layer and a heat-meltable ink on a thermal transfer sheet; and melting the ink by heat provided through a thermal transfer printer head from the back side of the thermal transfer sheet, thereby infiltrating the ink into the porous ink-receiving layer of the ink image-receiving sheet to form an image, wherein the ink image-receiving sheet comprises an ink-receiving layer having a porous structure formed according to a wet-solidification method, the ink-receiving layer comprising a binder resin and aragonite-type calcium carbonate as main components.

6. A method of forming an image, comprising the steps of:

superimposing an ink image-receiving sheet having a porous ink-receiving layer and each of a plurality of different color heat-meltable inks on a thermal transfer sheet or on a plurality of thermal transfer sheets; and melting each ink by heat provided through a thermal transfer printer head from the back side of the thermal transfer sheet, thereby successively infiltrating the plurality of different color inks into the porous ink-receiving layer of the ink image-receiving sheet to form a color image, wherein the ink image-receiving sheet comprises an ink-receiving layer having a porous structure formed according to a wet-solidification method, the ink-receiving layer comprising a binder resin and aragonite-type calcium carbonate as main components.

* * * * *